US006558240B2

(12) United States Patent
Negley

(10) Patent No.: US 6,558,240 B2
(45) Date of Patent: May 6, 2003

(54) HONING TOOL

(75) Inventor: Marvin C. Negley, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 09/952,813

(22) Filed: Sep. 14, 2001

(65) Prior Publication Data

US 2003/0054743 A1 Mar. 20, 2003

(51) Int. Cl.[7] ..... B24B 9/02

(52) U.S. Cl. ..... 451/464; 451/470; 451/473; 451/483

(58) Field of Search ..... 451/464, 465, 451/470, 471, 472, 473, 477, 482, 483

(56) References Cited

U.S. PATENT DOCUMENTS 1,647,133 A * 11/1927 Jennings ..... 451/483
1,647,134 A * 11/1927 Jennings ..... 451/483
1,739,956 A * 12/1929 Emerson ..... 451/464
1,869,377 A * 8/1932 Johnson et al. ..... 451/479
1,926,835 A * 9/1933 Cook ..... 451/479
1,982,836 A * 12/1934 Sunnen ..... 451/479
2,736,146 A 2/1956 Brooks
2,778,168 A * 1/1957 Clark ..... 451/465
2,989,825 A * 6/1961 Smith ..... 451/471
3,381,419 A * 5/1968 Johnson ..... 451/465
3,624,693 A * 11/1971 Werner et al. ..... 451/483
4,615,152 A * 10/1986 Bogaerts ..... 451/485

* cited by examiner

*Primary Examiner*—M. Rachuba
(74) *Attorney, Agent, or Firm*—Banner & Witcoff, Ltd.

(57) ABSTRACT

A rotary honing tool includes a rotatable body member mounted on a shaft and having attached rotatable honing arms as well as a band or collar fitted about the body. The collar is engaged with the body by means of a lug on the collar fitted into a channel on the outside face of the cylindrical body. The collar may be rotatably displaced to control radial extention of the honing arms.

8 Claims, 2 Drawing Sheets

FIG.1
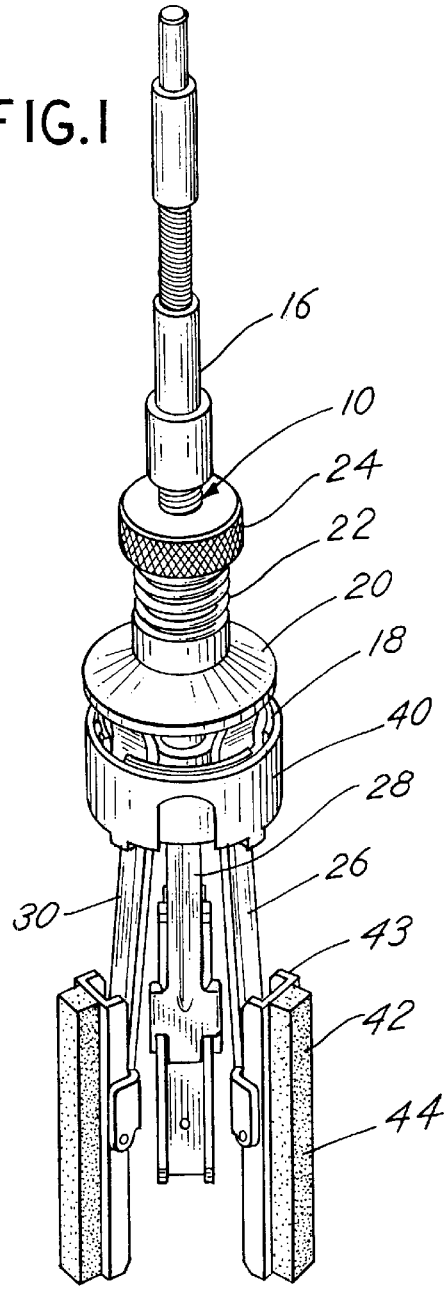
FIG.2
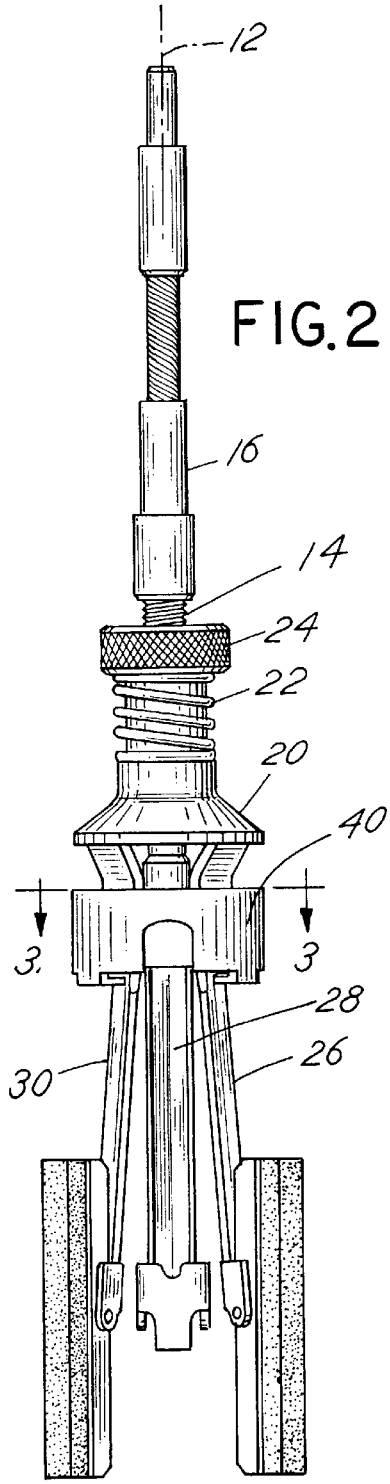
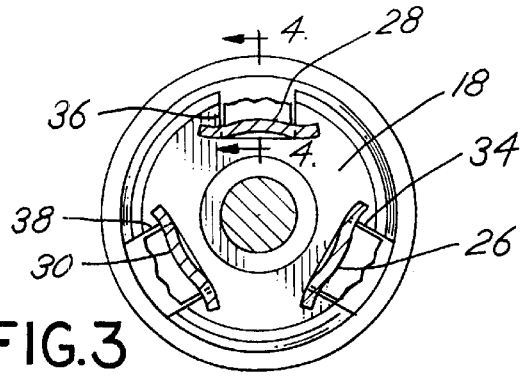
FIG.3

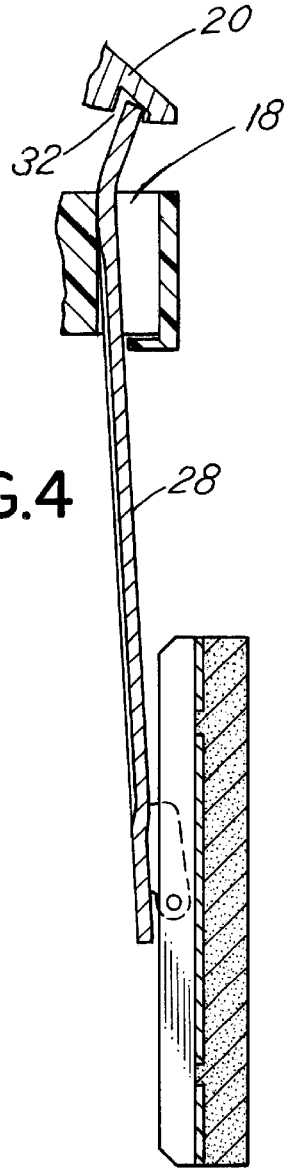
FIG.4
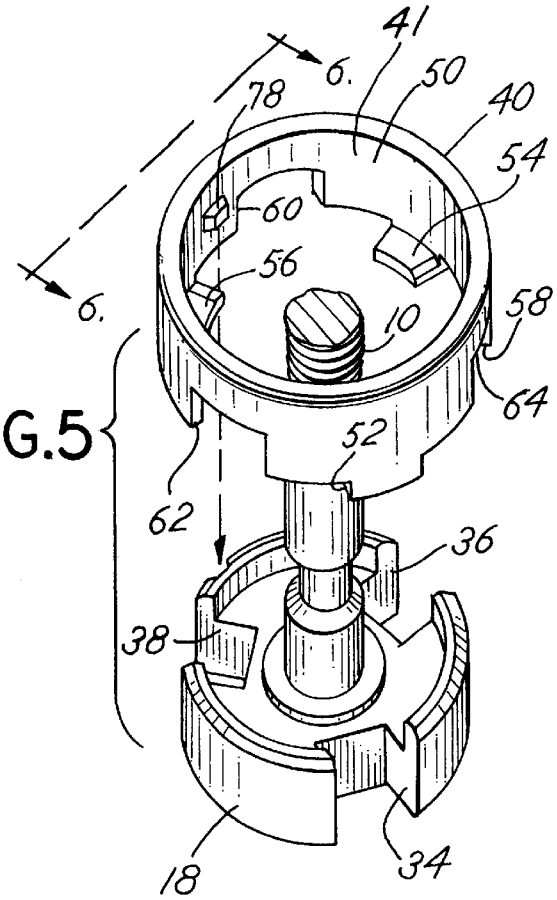
FIG.5
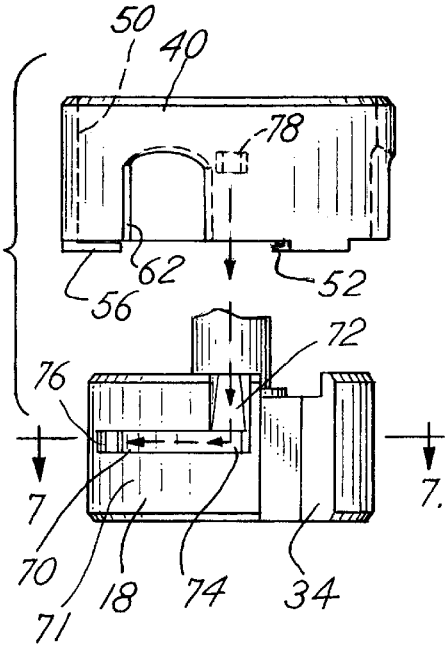
FIG.6
FIG.7
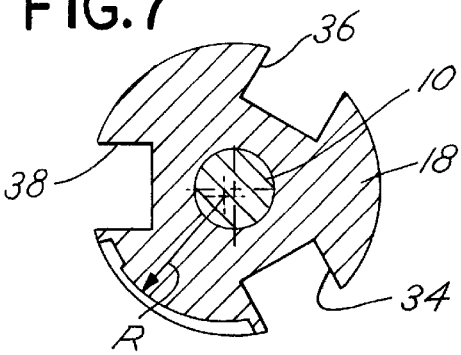

HONING TOOL

BACKGROUND OF THE INVENTION

In a principal aspect, the present invention relates to a rotary honing tool comprised of honing blades mounted on arms projecting from a rotating body. The arms are biased outwardly for engagement with the cylindrical wall of an engine cylinder. More particularly, the invention relates to a mechanism for controlling the radial position of the honing arms.

The use of a cylinder honing tool to polish or hone the cylinder of an engine block has been facilitated by the use of various special tools. U.S. Pat. No. 2,736,146 for a Cylinder Hone issued Feb. 28, 1956 discloses a tool that has such use. The tool disclosed in U.S. Pat. No. 2,736,146 has been popular and generally, commercially successful. U.S. Pat. No. 2,736,146 is incorporated herewith by reference in its entirety as disclosing a prior art construction.

One of the features of the tool depicted in U.S. Pat. No. 2,736,146 is the use of a collar that controls or limits the radial position or outward extent of the honing arms to which the cylinder honing stones are attached. To adjust this collar and thus adjust the radial position or limit of outward radial movement the honing stones, it is necessary to release a screw that holds the collar in position and then manually rotate the collar followed by resetting the screw. This screw and collar adjustment is often time consuming and troublesome especially in the event that a screwdriver or similar tool is not available to facilitate the loosening and retightening of the screw holding the rotatable collar. Thus there has developed the need for an improved mechanism which will enable engagement and release of the collar which holds cylinder hone support arms.

SUMMARY OF THE INVENTION

Briefly the present invention comprises a rotary honing tool of a type that includes a rotary drive shaft, a body mounted on the drive shaft with a center line axis coincident with the drive shaft axis, and at least one honing support arm extending through a radial guide channel in the body. A biasing element engages and biases the honing arm radially outwardly in the channel. The improvement of the invention comprises an adjustable collar rotatably mounted on the body. The collar includes at least a first and a second detent position which, respectively, permit the hone arm, or arms, to extend radially outwardly to engage the cylinder walls or, alternatively, to hold the hone arms tightly in a position of non-engagement closely aligned with the rotation axis of the tool. The collar thus includes an inwardly projecting tab which fits within a rotational guide slot or channel defined in outside surface of the body. This tab may engage into any one or more detent recesses in the channel and it is also cooperative with an axial channel of the body parallel to the shaft axis that is also provided in the outer surface of the body. The axial channel facilitates assembly of the collar to the body when axially sliding the collar onto the body. The collar further includes inwardly projecting fingers or lips designed to engage the honing arms and hold them in their retracted or inward position aligned with the axis of the tool. Upon rotation of the collar, the fingers may disengage from the arms permitting them to move outwardly to their released position of engagement for honing the cylinder walls.

Thus it is an object of the invention to provide an improved honing tool having a collar that may be easily and manually actuated to control the angular relationship of the arms projecting from the honing tool.

It is a further objection of the invention to provide a honing tool which is rugged, inexpensive, and constitutes a low cost modification of prior art tools and which is economical to manufacture and easy to use.

These and other objects, advantages, and features of the invention will be set forth in the detailed description that follows.

BRIEF DESCRIPTION OF THE DRAWING

In the detailed description that follows reference will be made to the drawing comprised of the following figures.

FIG. 1 is an isometric view of the honing tool of the invention wherein the collar is positioned to retain the honing arms inwardly on the body of the tool;

FIG. 2 is a side elevation of the tool of FIG. 1;

FIG. 3 is a cross sectional view of the tool of FIG. 2 taken along the line 3—3;

FIG. 4 is as cross sectional view of the collar in combination with the body member taken along the line 4—4 of FIG. 3;

FIG. 5 is an exploded isometric view depicting the body member and collar for the tool;

FIG. 6 is a side elevation of the body and collar shown in FIG. 5; and

FIG. 7 is a cross sectional view of the body member of FIG. 6 taken along the line of 7—7.

DESCRIPTION OF THE PREFERRED EMBODIMENT

The cylinder hone includes an axial drive shaft 10 that defines a rotation axis 12. The drive shaft 10 is threadably connected at its outer end 14 to a connector 16. The connector 16 is adapted to be connected to a drive mechanism such as a power drill or the like to effect rotation of the shaft 10. The opposite or inner end of the shaft 10 is connected to a body member 18. A cone member 20 is concentrically mounted on the shaft 10 with a coil spring 22 biased by an adjusting nut 24 threaded on the outer end 14 of the shaft 10. First, second and third hone arms 26, 28, and 30 are pivotally attached at their inner end to the underside of the cone member 20 by insertion into slots such as slot 32 defined on the underside of the cone member 20. Each of the arms 26, 28, and 30 fit through separate longitudinal channels 34, 36, and 38 defined in the body member 18 at equally spaced positions about the axis 12. The channels 34, 36, and 38 receive the arms 26, 28, and 30, respectively, and provide a guide for the arms 26, 28, 30 as well as a means for retaining the arms 26, 28, and 30 and driving the arms 26, 28, and 30 by rotation of the shaft 10 about the axis 12.

The arms 26, 28, and 30 are held in position within their respective channels 34, 36, and 38 by means of a band or collar 40. The outer end of each of the hone arms 26, 28, and 30 has a hone or honing stone 42 in a housing 43 pivotally attached thereto. The hones 42 include a face surface 44 adapted to engage against the walls of a cylinder upon the rotation of the shaft 10 for polishing or honing the inside surface of the cylinder.

The present invention relates to the construction of the band or collar 40 alone and in combination with the elements comprising the cylinder hone. The cylinder hone as described is substantially as set forth in U.S. Pat. No. 2,736,146 but for the addition or substitution of the band or collar 40 in the embodiment of the present invention in place of ring 54 as depicted in U.S. Pat. No. 2,736,146.

More specifically the band or collar 40 is formed from a glass filled nylon material; typically a 30 percent glass filled nylon. The band or collar 40 is cylindrical in shape and includes a through passage 50. The band or collar 40 has a generally uniform diameter substantially equal to the outside diameter of the body member 18 so that it may smoothly slide on and be rotated with respect to the cylindrical body member 18. The band or collar 40 further includes first, second, and third inwardly radially projecting, equally spaced lips 52, 54, and 56. The lips 52, 54, and 56 have a width dimension which is less than the width of channels 34, 36, and 38 so that the lips 52, 54, and 56 may fit over as well as slide into the channels 34, 36, and 38.

The collar 40 further includes a first sidewall slot 58, a second side wall slot 60, and a third side wall slot 62 adjacent respectively to the lips 52, 54, and 56. The slots 58, 60, and 62 have a width which exceeds the width of the hone arms 26, 28, and 30 so that the hone arms 26, 28, and 30 may fit through the slots 58, 60, and 62 and move radially outward limited only by the upper edge of each of the slots 58, 60, 62, for example by the upper edge 64 of the slot 58. Thus the slots 58, 60, and 62 are equally spaced about the periphery of the band or collar 40. When the collar 40 is in the proper rotation orientation or position as rotated about the axis 12, the hone arms 26, 28, and 30 may extend outwardly radially from the cone member 20 through the channels 34, 36, and 38.

In addition to the channels 34, 36, and 38, the body member 18 includes a partially circumferential slot or channel 70 which is connected with a longitudinal axial slot 72. Axial slot 72 as well as channel 70 are on the outside face or surface 71 of the body member 18. Axial slot 72 is generally parallel to the axis 12. The peripheral channel or slot 70 is generally perpendicular to the axis 12 and extends partially about the circumference of the body member 18 between two channels, for example, channels 36 and 38.

The channel or slot 70 further includes a first detent or depression 74 at one end and a second detent or depression 76 at its opposite end. The detents 74 and 76 are adapted to receive an inwardly extending lug, tab, or guide member 78 on the inside surface 41 of the collar 40. The lug 78 is positioned adjacent to the lip 56 and generally adjacent one of the slots 60 so that the collar 40 may be assembled onto the body 18 by sliding the collar 40 axially downwardly on the body 18 along the axis 12 so that the lug 78 will fit into the axial slot 72. The depth of the axial slot 72 is less than the depth of the detents 74 and 76. Thus the lug 78 will ride over the face or surface of the axial slot 72 and fall into the detent 74 to be retained thereby. The depth of the channel 70 between the detents 74 and 76 is lesser then the depth of the detents 74 and 76 to provide a "feel" upon rotation of the band or collar 40 about the axis 12 as depicted in FIG. 6. The shape of the channel 72 may thus be customized to provide desired "feel" and detect retention.

With the construction so described, the collar or band 40 may be inserted over the body 18 by axial movement of lug 78 in slot 72 and lips 50, 54 and 56 in channels 34, 36, and 38. Then collar 40 may be rotationally positioned into one of the two detent positions 74 or 76 to alternately hold the hone arms 26, 28, and 30 inwardly by means of the lips 50, 54, and 56 or alternately to permit the arms 26, 28, and 30 to expand outwardly through the slots 58, 60, and 62.

Adjustment of the hone arms 26, 28, and 30 may then be effected by gripping the arms 26, 28, and 30 and moving them inwardly while rotating the band or collar 40 to engage the lips 52, 54, and 56 therewith. Alternatively the hone arms 26, 28, 30 may be released and expand outwardly upon rotation of the band or collar 40 so that the channels 58, 60, and 62 will receive the arms 26, 28, and 30.

With the construction of the invention it is therefore possible to adjust the position of the hone arms 26, 28, and 30 and their angular displacement from the axis 12 by merely rotating the collar 40. In the embodiment shown there are only two positions for the hone arms 26, 20, 30; namely the position defined by lips 52, 54, and 56 and the position defined by channels 58, 60, and 62. It is possible to provide additional "steps" for control of the displacement of those arms 26, 28, 30. Thus there are alternative constructions to the invention. The invention is therefore to be limited only by the following claims and equivalents thereof.

What is claimed is:

1. In a rotary honing tool of the type including a rotary drive shaft; a body having an axis, a radial guide channel and an outside surface, said body mounted on the shaft; at least one support arm extending through said radial guide channel in the body; a biasing element for biasing the support arm in the radial guide channel outwardly, the improvement comprising, in combination:

an adjustment collar rotatably mounted on the body, said collar having an inside surface, said collar including at least one slot alignable with the radial guide channel upon rotation of the collar on the body to thereby allow radial extension of said arm, said collar further including a guide tab on the inside surface projecting toward the axis, said body including a slot in the outside surface for receipt of the collar guide tab to thereby retain the collar on the body.

2. The tool of claim 1 wherein the slot extends partially around the circumference of the body to limit rotational travel of the collar.

3. The tool of claim 1 wherein the body includes an axial slot connected to the slot for receipt of the tab by axial movement of the collar on the body.

4. The tool of claim 1 wherein the collar includes at least one inwardly projecting retention lip for limiting axial movement of the collar on the body and for engaging and holding an arm against radial outward movement when the lip is aligned with the arm.

5. The tool of claim 1 wherein the slot includes at least one detent for receipt of the tab to releasably retain the tab and the collar in a fixed position on the body.

6. The tool of claim 2 wherein the slot extends partially around the circumference of the body and includes recess detents to releasably retain the collar in a first and a second detent position respectively.

7. The tool of claim 2 including an axial slot in the body connected to the slot.

8. The tool of claim 1 including a radially inwardly projecting lip on the collar for engaging and holding an arm against radial outward movement when the lip is aligned with an arm.

* * * * *